US007481357B1

(12) United States Patent
Totis

(10) Patent No.: US 7,481,357 B1
(45) Date of Patent: Jan. 27, 2009

(54) COMBINED RUBBER MAILBOX AND SWIVEL MOUNT ASSEMBLY AND ASSOCIATED METHOD

(76) Inventor: Victor Totis, 2824 Shamer La., Hampstead, MD (US) 21074

( * ) Notice: Subject to any disclaimer, the term of this patent is extended or adjusted under 35 U.S.C. 154(b) by 0 days.

(21) Appl. No.: 11/986,216

(22) Filed: Nov. 20, 2007

Related U.S. Application Data

(60) Provisional application No. 60/859,907, filed on Nov. 20, 2006.

(51) Int. Cl.
*A47G 29/12* (2006.01)

(52) U.S. Cl. ..... 232/39; 248/145

(58) Field of Classification Search ..... 232/39; 248/145, 125.7, 131
See application file for complete search history.

(56) References Cited

U.S. PATENT DOCUMENTS 2,149,050 A * 2/1939 Hajicck ..... 248/145
4,113,213 A * 9/1978 Gay et al. ..... 248/128
4,130,239 A * 12/1978 Belsheim ..... 232/39
4,995,576 A * 2/1991 Kieswetter ..... 248/145
5,215,283 A 6/1993 Gould
5,713,514 A 2/1998 Eck
5,779,202 A 7/1998 Black
2002/0139904 A1* 10/2002 Lowell ..... 248/145

* cited by examiner

*Primary Examiner*—William L. Miller

(57) ABSTRACT

A combined mailbox and swivel mount assembly includes a mailbox made from durable rubber material and an elongated and rectilinear post with axially opposed ends. The assembly further includes a mounting bracket, a rectilinear support shaft, and a base bracket fixedly and statically coupled to an underside of the mailbox. A sleeve is monolithically formed with a posterior side of the base bracket. Such a sleeve has a longitudinal length registered parallel with a longitudinal length of the post, and is rotatably coupled to the mounting bracket in such a manner that the base bracket and the mailbox freely articulate in sync about a fulcrum axis defined parallel to the sleeve and along an arcuate path defined substantially anterior of the post.

15 Claims, 6 Drawing Sheets

COMBINED RUBBER MAILBOX AND SWIVEL MOUNT ASSEMBLY AND ASSOCIATED METHOD

CROSS REFERENCE TO RELATED APPLICATIONS

This application claims the benefit of U.S. Provisional Application No. 60/859,907, filed Nov. 20, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to mailboxes and, more particularly, to a combined rubber mailbox and swivel mount assembly for absorbing impact forces during extended periods of time.

2. Prior Art

Urban and rural mailbox posts have long since been a source of constant maintenance and damage repair. If proper upkeep is not provided, the result is often rather unsightly and mail delivery is often interrupted. The greatest potential damage to a mailbox comes from snow plows moving down the road at a moderate to high rate of speed. Attempting to do the best job possible of clearing the road, the plow gets as close to the edge of the road as possible without hitting the mailboxes. Even if the snow plow blade misses the mailbox, the snow trailing off the plow blade has been known to completely destroy even the sturdiest mailbox post.

Furthermore, in many parts of the United States, teenagers and young adults make a "sport" of driving at high speed along the road with windows rolled down; and upon approaching a roadside mailbox, a baseball bat or similar weapon is extended through the automobile's open window in an attempt to strike the mailbox. Such acts of vandalism typically result in destruction of the mailbox and mailbox support stand. In response to such activities, mailbox stands of heavy and bulky construction, using high strength materials have become common throughout rural America. Such mailboxes are expensive to construct, they are difficult to transport and install, and they generally are not aesthetically pleasing to the eye.

U.S. Pat. No. 5,215,283 to Gould discloses a improved mailbox support that includes a sectional post interconnected by a resilient coupling. The coupling includes a cam and an adjustable internal primary spring, and an optional external secondary spring. Unfortunately, this prior art example does not include an impact resistant mailbox.

U.S. Pat. No. 5,713,514 to Eck discloses a mailbox stand comprising a vertical support sleeve, a vertical extension shaft rotatably and vertically adjustably mounted within and extending vertically from the upper opening of the bore of the vertical support sleeve, a support arm pivotally attached to the upper end of the vertical extension shaft, a mailbox attachment bracket fixedly attached to the support arm, a first breakaway plate fixedly attached to the lower end of the vertical support sleeve, a second breakaway plate fixedly attached to the lower surface of the first breakaway plate by means of threaded bolts, and a breakaway plate support shaft fixedly attached to and extending downward from the lower surface of the second breakaway plate. Unfortunately, this prior art example does not include swiveling bracket slides to allow free movement of a mailbox.

U.S. Pat. No. 5,779,202 to Black discloses a pivoting mailbox post that is provided having a mailbox support arm that can be pivoted 360 degrees and easily returned to its normal resting position. It has an adjustment nut that allows increased tension on mailbox support arm for various weather conditions. At all times the support arm is maintained in a horizontal position and does not tilt. The homeowner can swing support arm completely around to empty contents without venturing into the street and traffic. This invention can be easily assembled and transported by the majority of homeowners. The pivoting mailbox will also have the ability to have damaged parts replaced. Unfortunately, this prior art example does not include an impact resistant mailbox.

Accordingly, the present invention is disclosed in order to overcome the above noted shortcomings. The present invention is convenient and easy to use, lightweight yet durable in design, and designed for absorbing impact forces during extended periods of time. The combined mailbox and swivel mount assembly is simple to use, inexpensive, and designed for many years of repeated use.

BRIEF SUMMARY OF THE INVENTION

In view of the foregoing background, it is therefore an object of the present invention to provide an apparatus for absorbing impact forces during extended periods of time. These and other objects, features, and advantages of the invention are provided by a combined mailbox and swivel mount assembly.

A combined mailbox and swivel mount assembly includes a mailbox made from durable rubber material and an elongated and rectilinear post with axially opposed ends. The assembly further includes a mounting bracket fixedly and statically coupled directly to an anterior side of the post. Such a mounting bracket effectively extends forwardly towards the mailbox and terminates anterior thereof and further includes a planar bottom segment oriented perpendicular to the post and extending forwardly therefrom in such a manner that the bottom segment lies subjacent to the mailbox. A primary support segment has a bottom end directly attached to a top surface of the bottom segment and extending upwardly therefrom, and the primary support segment has a sloping shoulder offset from a vertical plane such that the primary support segment is bifurcated into first and second vertically oriented sections.

A rectilinear support shaft conveniently extends upwardly from the planar bottom segment and is disposed posterior of the posterior side of the mailbox. Such a support shaft has a sloping top end obliquely angled from a vertical plane. The mounting bracket is detachably engaged with the base bracket by upwardly lifting the mounting bracket along the fulcrum axis.

The kit further includes a base bracket fixedly and statically coupled to an underside of the mailbox. Such a base bracket terminates anterior to a posterior side of the mailbox and includes first and second rectilinear members directly connected to each other and forming an elbow positioned adjacent to the posterior side of the mailbox, and a bracket coupled directly to the first and second members for advantageously supporting a weight of the mailbox exerted thereagainst. Such a second member is oriented parallel to the support shaft and disposed anterior thereof.

The kit further includes a sleeve monolithically formed with a posterior side of the base bracket. Such a sleeve has a longitudinal length registered parallel with a longitudinal length of the post. The sleeve is rotatably coupled to the mounting bracket in such a manner that the base bracket and the mailbox freely and effectively articulate in sync about a fulcrum axis defined parallel to the sleeve and along an arcuate path defined substantially anterior of the post. The sleeve is disposed anterior of the post, and has a sloping bottom end obliquely angled from a vertical plane such that the bottom end corresponds to a sloping angle of the top end of the support shaft and lays symmetrically engaged therewith to thereby freely swivel the sleeve about the support shaft. The sleeve is positioned at a top end of the second member so that a bottom surface of the mailbox remains spaced above the bottom segment of the mounting bracket.

A method for absorbing impact forces during extended periods of time includes the steps of: providing a mailbox made from durable rubber material; providing an elongated and rectilinear post with axially opposed ends; fixedly and statically coupling a mounting bracket directly to an anterior side of the post by extending the mounting bracket forwardly towards the mailbox such that the mounting bracket terminates anterior thereof; fixedly and statically coupling a base bracket to an underside of the mailbox such that the base bracket terminates anterior to a posterior side of the mailbox; providing a sleeve monolithically formed with a posterior side of the base bracket such that the sleeve becomes disposed anterior of the post and registered parallel with the post; and rotatably coupling the sleeve to the mounting bracket in such a manner that the base bracket and the mailbox freely articulate in sync about a fulcrum axis defined parallel to the sleeve and along an arcuate path defined substantially anterior of the post.

The method further includes the steps of: orienting a planar bottom segment perpendicular to the post by extending the planar bottom segment forwardly therefrom in such a manner that the bottom segment lies subjacent to the mailbox; directly attaching a bottom end of a primary support segment to a top surface of the bottom segment by extending the primary support segment upwardly therefrom; and upwardly extending a rectilinear support shaft from the planar bottom segment by disposing the support shaft posterior to the posterior side of the mailbox.

The method further includes the steps of: directly connecting first and second rectilinear members to each other and forming an elbow positioned adjacent to the posterior side of the mailbox; directly coupling a bracket to the first and second members for supporting a weight of the mailbox exerted thereagainst; and orienting the second member parallel to the support shaft by disposing the second member anterior thereof.

The method further includes the steps of: freely swiveling the sleeve about the support shaft; positioning the sleeve at a top end of the second member so that a bottom surface of the mailbox remains spaced above the bottom segment of the mounting bracket; and detachably engaging the mounting bracket with the base bracket by upwardly lifting the mounting bracket along the fulcrum axis.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
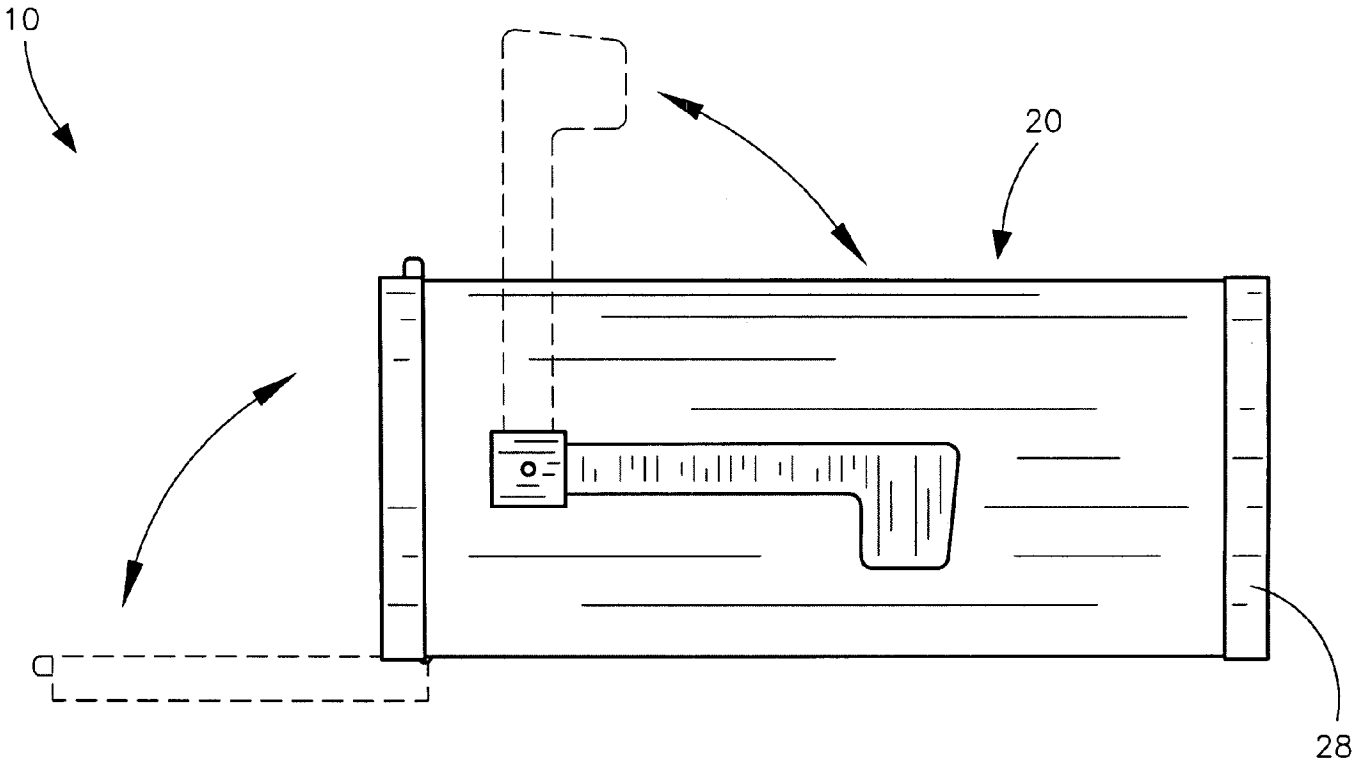
FIG. 1 is a side elevational view of a mailbox, in accordance with the present invention.
Figure 2:
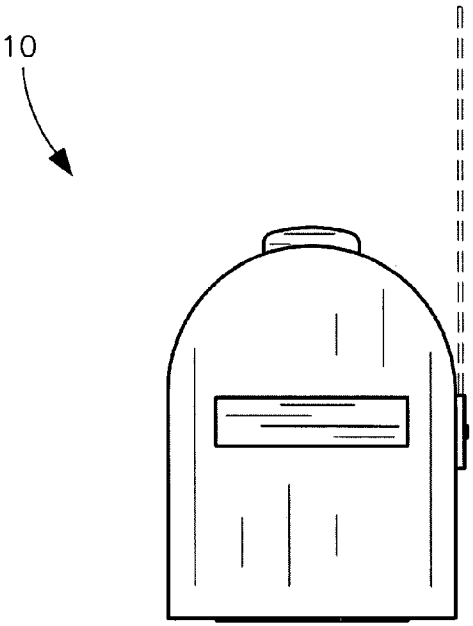
FIG. 2 is a side elevational view of a base bracket, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-6 by the reference numeral 10 and is intended to protect a combined mailbox and swivel mount assembly. It should be understood that the assembly 10 may be used to protect many different types of mailboxes and should not be limited in use to only those mailboxes mentioned herein.

Referring initially to FIGS. 1, 2, 3, 4, 5 and 6, a combined mailbox and swivel mount assembly 10 includes a mailbox 20 made from durable rubber material and an elongated and rectilinear post 21 with axially opposed ends. The assembly further includes a mounting bracket 22 fixedly and statically coupled directly, without the use of intervening elements, to an anterior side 23 of the post 21. Such a mounting bracket 22 extends forwardly towards the mailbox 20 and terminates anterior thereof and includes a planar bottom segment 24 oriented perpendicular to the post 21 and extending forwardly therefrom in such a manner that the bottom segment 24 lies subjacent to the mailbox 20. A primary support segment 25 has a bottom end directly attached, without the use of intervening elements, to a top surface of the bottom segment 24 and extending upwardly therefrom, and the primary support segment 25 has a sloping shoulder offset from a vertical plane which is essential such that the primary support segment 25 is bifurcated into first and second vertically oriented sections. The mounting bracket 22 is provided for mounting the mailbox 20 to the rectilinear post 21.

A rectilinear support shaft 26 extends upwardly from the planar bottom segment 24 and is disposed posterior of the posterior side of the mailbox 20. Such a support shaft 26 has a sloping top end obliquely angled from a vertical plane. The mounting bracket 22 is detachably engaged with a base bracket 27 by upwardly lifting the mounting bracket 22 along the fulcrum axis.

Figure 3:
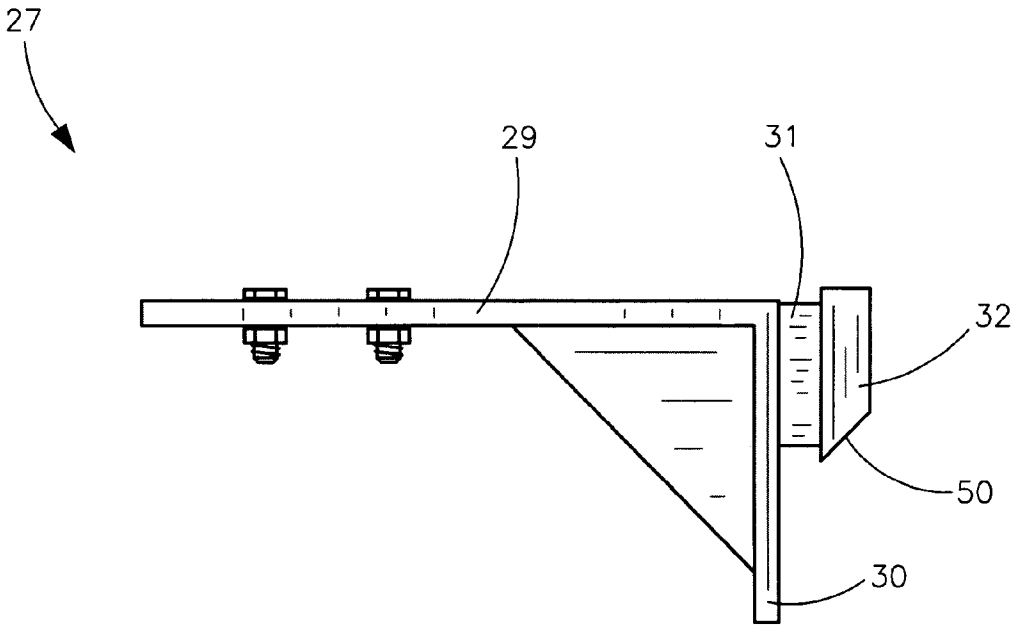
FIG. 3 is a front elevational view of a mailbox, in accordance with the present invention.
Figure 4:
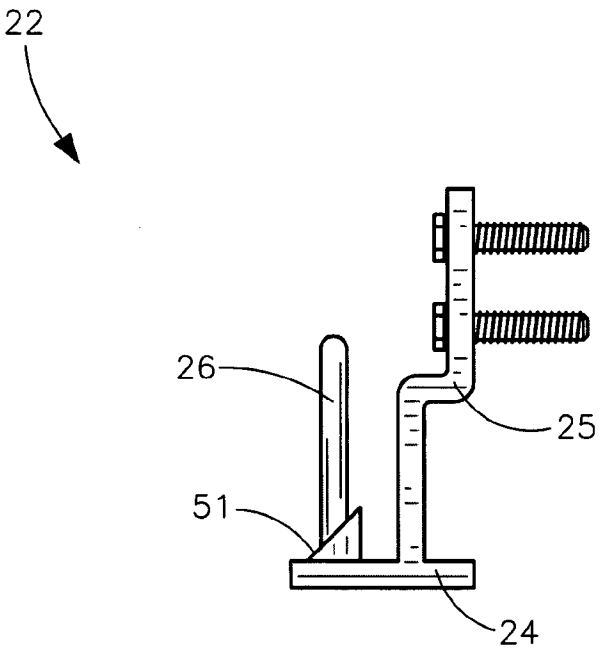
FIG. 4 is a side elevational view of a mounting bracket, in accordance with the present invention.
Figure 5:
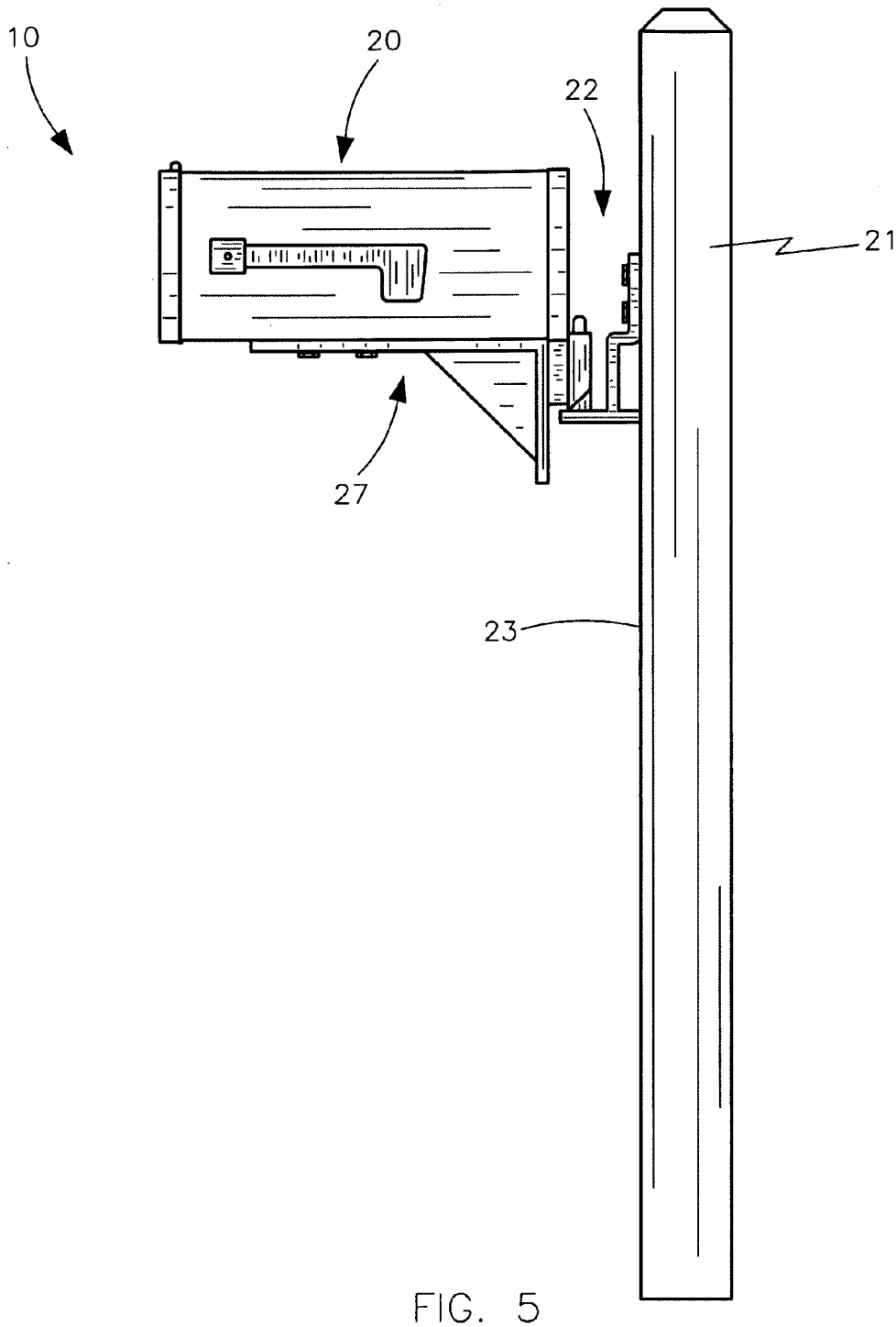
FIG. 5 is a side elevational view of a combined mailbox and swivel mount assembly, in accordance with the present invention.
Figure 6:
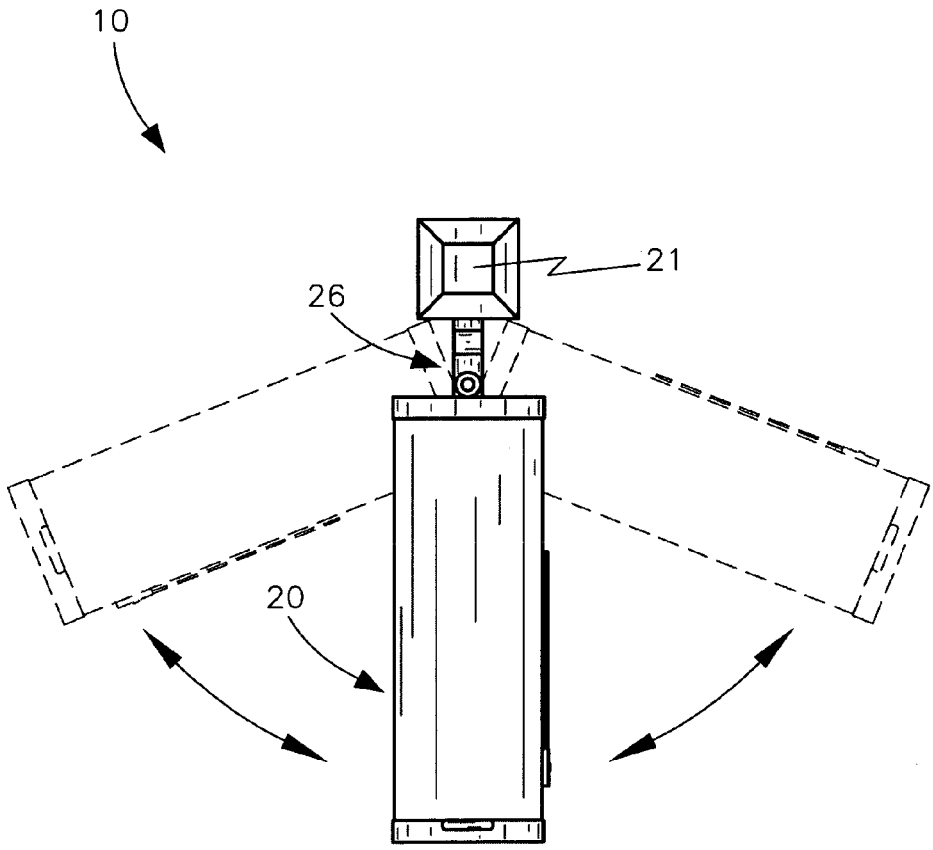
FIG. 6 is a top planar view of a combined mailbox and swivel mount, in accordance with the present invention.

Referring to FIG. 3, the kit 10 further includes the base bracket 27 fixedly and statically coupled to an underside of the mailbox 20. Such a base bracket 27 terminates anterior to a posterior side 28 of the mailbox 20 and includes first and second rectilinear members 29, 30 directly connected, without the use of intervening elements, to each other and forming an elbow positioned adjacent to the posterior side 28 of the mailbox 20, and a bracket 31 coupled directly, without the use of intervening elements, to the first and second members 29, 30 for supporting a weight of the mailbox 20 exerted thereagainst. Such a second member 30 is oriented parallel to the support shaft 26 and disposed anterior thereof. The base bracket 27 is provided for supporting the weight of the mailbox 20.

Referring again to FIG. 3, the kit 10 further includes a sleeve 32 monolithically formed with a posterior side of the base bracket 27. Such a sleeve 32 has a longitudinal length registered parallel with a longitudinal length of the post 21. The sleeve 32 is rotatably coupled to the mounting bracket 22 in such a manner that the base bracket 27 and the mailbox 20 freely articulate in sync about a fulcrum axis defined parallel to the sleeve 32 and along an arcuate path defined substantially anterior of the post 21. The sleeve 32 is disposed anterior of the post 21, and has a sloping bottom end 50 obliquely angled from a vertical plane which is important such that the bottom end corresponds to a sloping angle of the top end 51 of the support shaft 26 and lays symmetrically engaged therewith to thereby freely swivel the sleeve 32 about the support shaft 26. The sleeve 32 is positioned at a top end of the second member 30 so that a bottom surface of the mailbox 20 remains spaced above the bottom segment of the mounting bracket 22. The sleeve 32 enables the base bracket 27 to be connected to the support shaft 26 of the mounting bracket 22.

The assembly includes a sturdy mailbox, a metal mounting bracket, a swiveling base bracket, and threaded fasteners necessary for installation. Such a mailbox is substantially the same size and shape as a standard mailbox and is produced from reinforced rubber material. The swiveling base bracket is firmly and directly attached, without the use of intervening elements, to a bottom surface of the mailbox. An open cylinder of the base bracket is effectively allowed to rotate on a post of the mounting bracket, which is securely attached to the post. Of course, assembly and installation instructions could be provided upon purchase, as is obvious to a person of ordinary skill in the art. When still, the mailbox faces forward per usual. Should the mailbox be intentionally or inadvertently hit or pushed in either direction, it effectively and advantageously rotates away from the applied force. When the force is released, the mailbox conveniently returns to the original position automatically or can be pushed back manually.

The present invention, as claimed, provides the unexpected and unpredictable benefit of an assembly that is convenient and easy to use, is durable yet lightweight in design, is easily installed, and provides an innovative and practical improvement to the conventional mailbox. The sturdy pliability of reinforced rubber material advantageously greatly reduces any damage caused by weather, snowplows, vehicles, or baseball bat-swinging vandals. The present invention can also effectively resist damage caused by warehouse forklifts or during shipping. When forced upon, the flexible assembly swivels in accordance to the impact. Both of these features advantageously and effectively add to the enduring resilience of the impact resistant mailbox.

In use, a method for absorbing impact forces during extended periods of time includes the steps of: providing a mailbox 20 made from durable rubber material; providing an elongated and rectilinear post 21 with axially opposed ends; fixedly and statically coupling a mounting bracket 22 directly, without the use of intervening elements, to an anterior side 23 of the post 21 by extending the mounting bracket 22 forwardly towards the mailbox 20 such that the mounting bracket 22 terminates anterior thereof; fixedly and statically coupling a base bracket 27 to an underside of the mailbox 20 such that the base bracket 27 terminates anterior to a posterior side 28 of the mailbox 20; providing a sleeve 32 monolithically formed with a posterior side of the base bracket 27 such that the sleeve 32 becomes disposed anterior of the post 21 and registered parallel with the post 21; and rotatably coupling the sleeve 32 to the mounting bracket 22 in such a manner that the base bracket 27 and the mailbox 20 freely articulate in sync about a fulcrum axis defined parallel to the sleeve 32 and along an arcuate path defined substantially anterior of the post 21.

In use, the method further includes the steps of: orienting a planar bottom segment perpendicular to the post 21 by extending the planar bottom segment 24 forwardly therefrom in such a manner that the bottom segment 24 lies subjacent to the mailbox 20; directly attaching, without the use of intervening elements, a bottom end of a primary support segment 25 to a top surface of the bottom segment 24 by extending the primary support segment upwardly therefrom; and upwardly extending a rectilinear support shaft 26 from the planar bottom segment 24 by disposing the support shaft 26 posterior to the posterior side 28 of the mailbox 20.

In use, the method further includes the steps of: directly connecting, without the use of intervening elements, first and second rectilinear members 29, 30 to each other and forming an elbow positioned adjacent to the posterior side 28 of the mailbox 20; directly coupling, without the use of intervening elements, a bracket 31 to the first and second members 29, 30 for supporting a weight of the mailbox 20 exerted thereagainst; and orienting the second member 30 parallel to the support shaft 26 by disposing the second member 30 anterior thereof.

In use, the method further includes the steps of: freely swiveling the sleeve 32 about the support shaft 26; positioning the sleeve 32 at a top end of the second member 30 so that a bottom surface of the mailbox 20 remains spaced above the bottom segment 24 of the mounting bracket 22; and detachably engaging the mounting bracket 22 with the base bracket 27 by upwardly lifting the mounting bracket 22 along the fulcrum axis.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined mailbox and swivel mount assembly for absorbing impact forces during extended periods of time, said combined mailbox and swivel mount assembly comprising:

a mailbox made from durable rubber material;

an elongated and rectilinear post having axially opposed ends;

a mounting bracket fixedly and statically coupled directly to an anterior side of said post;

a base bracket fixedly and statically coupled to an underside of said mailbox, said base bracket terminating anterior to a posterior side of said mailbox; and a sleeve monolithically formed with a posterior side of said base bracket, said sleeve having a longitudinal length registered parallel with a longitudinal length of said post;

wherein said sleeve is rotatably coupled to said mounting bracket in such a manner that said base bracket and said mailbox freely articulate in sync about a fulcrum axis defined parallel to said sleeve and along an arcuate path defined substantially anterior of said post.

2. The combined mailbox and swivel mount assembly of claim 1, wherein said mounting bracket comprises:

a planar bottom segment oriented perpendicular to said post and extending forwardly therefrom in such a manner that said bottom segment lies subjacent to said mailbox;

a primary support segment having a bottom end directly attached to a top surface of said bottom segment and extending upwardly therefrom, said primary support segment having a sloping shoulder offset from a vertical plane such that said primary support segment is bifurcated into first and second vertically oriented sections; and a rectilinear support shaft extending upwardly from said planar bottom segment and being disposed posterior of the posterior side of said mailbox.

3. The combined mailbox and swivel mount assembly of claim 2, wherein said base bracket comprises:

first and second rectilinear members directly connected to each other and forming an elbow positioned adjacent to the posterior side of said mailbox; and a bracket coupled directly to said first and second members for supporting a weight of said mailbox exerted thereagainst;

wherein said second member is oriented parallel to said support shaft and disposed anterior thereof.

4. The combined mailbox and swivel mount assembly of claim 2, wherein said sleeve freely swivels about said support shaft.

5. The combined mailbox and swivel mount assembly of claim 1, wherein said mounting bracket is detachably engaged with said base bracket by upwardly lifting said mounting bracket along the fulcrum axis.

6. A combined mailbox and swivel mount assembly for absorbing impact forces during extended periods of time, said combined mailbox and swivel mount assembly comprising:

a mailbox made from durable rubber material;

an elongated and rectilinear post having axially opposed ends;

a mounting bracket fixedly and statically coupled directly to an anterior side of said post, said mounting bracket extending forwardly towards said mailbox and terminated anterior thereof;

a base bracket fixedly and statically coupled to an underside of said mailbox, said base bracket terminating anterior to a posterior side of said mailbox; and a sleeve monolithically formed with a posterior side of said base bracket, said sleeve having a longitudinal length registered parallel with a longitudinal length of said post;

wherein said sleeve is rotatably coupled to said mounting bracket in such a manner that said base bracket and said mailbox freely articulate in sync about a fulcrum axis defined parallel to said sleeve and along an arcuate path defined substantially anterior of said post.

7. The combined mailbox and swivel mount assembly of claim 6, wherein said mounting bracket comprises;

a planar bottom segment oriented perpendicular to said post and extending forwardly therefrom in such a manner that said bottom segment lies subjacent to said mailbox;

a primary support segment having a bottom end directly attached to a top surface of said bottom segment and extending upwardly therefrom, said primary support segment having a sloping shoulder offset from a vertical plane such that said primary support segment is bifurcated into first and second vertically oriented sections; and a rectilinear support shaft extending upwardly from said planar bottom segment and being disposed posterior of the posterior side of said mailbox, said support shaft having a sloping top end obliquely angled from a vertical plane.

8. The combined mailbox and swivel mount assembly of claim 7, wherein said base bracket comprises:

first and second rectilinear members directly connected to each other and forming an elbow positioned adjacent to the posterior side of said mailbox; and a bracket coupled directly to said first and second members for supporting a weight of said mailbox exerted thereagainst;

wherein said second member is oriented parallel to said support shaft and disposed anterior thereof.

9. The combined mailbox and swivel mount assembly of claim 7, wherein said sleeve is disposed anterior of said post, said sleeve having a sloping bottom end obliquely angled from a vertical plane such that said bottom end corresponds to a sloping angle of said top end of said support shaft and lays symmetrically engaged therewith to thereby freely swivel said sleeve about said support shaft.

10. The combined mailbox and swivel mount assembly of claim 6, wherein said mounting bracket is detachably engaged with said base bracket by upwardly lifting said mounting bracket along the fulcrum axis.

11. A method for absorbing impact forces during extended periods of time, said method comprising the steps of:

a. providing a mailbox made from durable rubber material;

b. providing an elongated and rectilinear post having axially opposed ends;

c. fixedly and statically coupling a mounting bracket directly to an anterior side of said post by extending said mounting bracket forwardly towards said mailbox such that said mounting bracket terminates anterior thereof;

d. fixedly and statically coupling a base bracket to an underside of said mailbox such that said base bracket terminates anterior to a posterior side of said mailbox;

e. providing a sleeve monolithically formed with a posterior side of said base bracket such that said sleeve becomes disposed anterior of said post and registered parallel with said post; and f. rotatably coupling said sleeve to said mounting bracket in such a manner that said base bracket and said mailbox freely articulate in sync about a fulcrum axis defined parallel to said sleeve and along an arcuate path defined substantially anterior of said post.

12. The method of claim 11, wherein step c. comprises the steps of:

orienting a planar bottom segment of the mounting bracket perpendicular to said post by extending said planar bottom segment forwardly therefrom in such a manner that said bottom segment lies subjacent to said mailbox;

directly attaching a bottom end of a primary support segment of the mounting bracket to a top surface of said bottom segment by extending said primary support segment upwardly therefrom; and upwardly extending a rectilinear support shaft of the mounting bracket from said planar bottom segment by disposing said support shaft posterior to the posterior side of said mailbox.

13. The method of claim 12, wherein step d. comprises the steps of:

directly connecting first and second rectilinear members of the base bracket to each other and forming an elbow positioned adjacent to the posterior side of said mailbox;

directly coupling a bracket of the base bracket to said first and second members for supporting a weight of said mailbox exerted thereagainst; and orienting said second member parallel to said support shaft by disposing said second member anterior thereof.

14. The method of claim 13, further comprising the steps of: freely swiveling said sleeve about said support shaft.

15. The method of claim 11, further comprising the step of: detachably engaging said mounting bracket with said base bracket by upwardly lifting said mounting bracket along the fulcrum axis.

* * * * *